US009627747B2

(12) United States Patent
Hong et al.

(10) Patent No.: US 9,627,747 B2
(45) Date of Patent: Apr. 18, 2017

(54) DUAL-POLARIZED MAGNETIC ANTENNAS

(71) Applicants: Yang-Ki Hong, Tuscaloosa, AL (US); Woncheo Lee, Tuscaloosa, AL (US)

(72) Inventors: Yang-Ki Hong, Tuscaloosa, AL (US); Woncheo Lee, Tuscaloosa, AL (US)

(73) Assignee: The Board of Trustees of the University of Alabama for and on behalf of the University of Alabama, Tuscaloosa, AL (US)

( * ) Notice: Subject to any disclaimer, the term of this patent is extended or adjusted under 35 U.S.C. 154(b) by 483 days.

(21) Appl. No.: 14/092,414

(22) Filed: Nov. 27, 2013

(65) Prior Publication Data

US 2014/0159973 A1 Jun. 12, 2014

Related U.S. Application Data

(60) Provisional application No. 61/730,821, filed on Nov. 28, 2012.

(51) Int. Cl.

| | |
|---|---|
| ***H01Q 1/00*** | (2006.01) |
| ***H01Q 7/08*** | (2006.01) |
| ***H01Q 1/36*** | (2006.01) |
| ***H01Q 1/38*** | (2006.01) |

(52) U.S. Cl.
CPC ..... *H01Q 1/36* (2013.01); *H01Q 1/38* (2013.01); *H01Q 7/08* (2013.01)

(58) Field of Classification Search
CPC ..... H01Q 7/08; H01Q 7/38
See application file for complete search history.

(56) References Cited

U.S. PATENT DOCUMENTS

| | | | |
|---|---|---|---|
| 4,464,663 | A | 8/1984 | Lalezari et al. |
| 5,327,148 | A | 7/1994 | How |
| 5,638,080 | A | 6/1997 | Orthmann et al. |
| 6,008,775 | A | 12/1999 | Bobowicz et al. |

(Continued)

FOREIGN PATENT DOCUMENTS

| | | |
|---|---|---|
| CN | 101472855 | 7/2009 |

OTHER PUBLICATIONS

Written Opinion of the International Searching Authority issued by the United States Patent and Trademark Office as the International Searching Authority for International Application No. PCT/US2013/072341, entitled Dual-Polarized Magnetic Antennas; Copenheaver, Blaine (Feb. 9, 2014).

(Continued)

*Primary Examiner* — Trinh Dinh
(74) *Attorney, Agent, or Firm* — Maynard, Cooper & Gale, P. C.; Jon E. Holland

(57) ABSTRACT

The present disclosure generally pertains to dual-polarized magnetic antennas that may be used in various applications and are particularly suited for use in mobile devices and systems. In one exemplary embodiment, a dual-polarized antenna has a ferrite substrate that provides for the use of small antenna elements and also provides broad bandwidth and good impedance matching and isolation making the antenna attractive for use in mobile applications. Such antenna also has nearly omnidirectional radiation patterns and orthogonal polarizations. Further, the radiator type may be selected depending on the desired effective permeability in order to control return loss, isolation, and fractional bandwidth (FBW).

23 Claims, 10 Drawing Sheets

(56) References Cited

U.S. PATENT DOCUMENTS

| | | | | |
|---|---|---|---|---|
| 7,495,625 | B2 | 2/2009 | Endo | |
| 7,777,677 | B2 * | 8/2010 | Bungo | H01Q 1/243 343/700 MS |
| 7,859,471 | B2 * | 12/2010 | Bungo | H01Q 1/243 343/700 MS |
| 7,924,235 | B2 | 4/2011 | Fujimoto et al. | |
| 8,253,643 | B2 * | 8/2012 | Kato | H01Q 1/2283 343/787 |
| 8,422,190 | B2 | 4/2013 | Ito | |
| 8,749,439 | B2 | 6/2014 | Rao | |
| 2002/0030626 | A1 * | 3/2002 | Nagumo | H01Q 1/243 343/700 MS |
| 2008/0007459 | A1 * | 1/2008 | Koskiniemi | H01Q 1/38 343/700 MS |
| 2008/0224937 | A1 | 9/2008 | Kimura | |
| 2009/0115673 | A1 | 5/2009 | Nysen | |
| 2009/0121955 | A1 * | 5/2009 | Kubo | G06K 19/07749 343/788 |
| 2009/0273534 | A1 * | 11/2009 | Gonda | C04B 35/2633 343/787 |
| 2010/0053014 | A1 | 3/2010 | Yosui et al. | |
| 2010/0277387 | A1 * | 11/2010 | Schantz | H01Q 1/273 343/788 |
| 2010/0289708 | A1 * | 11/2010 | Bungo | H01Q 1/243 343/702 |
| 2011/0001682 | A1 | 1/2011 | Rao | |
| 2012/0139792 | A1 | 6/2012 | Pan | |
| 2012/0235881 | A1 | 9/2012 | Pan | |
| 2013/0033406 | A1 | 2/2013 | Chae | |
| 2014/0112511 | A1 * | 4/2014 | Corbin | H05K 9/006 381/333 |

OTHER PUBLICATIONS

Yang, L., et al., "Design and Development of Compact Conformal RFID Antennas Utilizing Novel Flexible Magnetic Composite Materials for Wearable RF and Biomedical Applications," Antennas and Propagation Society International Symposium, 2008. AP-S 2008. IEEE , vol., No., pp. 1,4, Jul. 5-11, 2008.

Martin, L. J., et al., "Effect of Permittivity and Permeability of a Flexible Magnetic Composite Material on the Performance and Miniaturization Capability of Planar Antennas for RFID and Wearable Wireless Applications," IEEE Trans. Antennas Propag., vol. 32, p. 849, 2009.

Hong, et al., U.S. Appl. No. 14/263,251, entitled, "Magnetic Antenna Structures," filed Apr. 28, 2014.

Chao, et al., "Permittivity and Permeability Measurement of Spin-Spray Deposited Ni—Zn-Ferrite Thin Film Sample," IEEE Trans. on Magnetics., vol. 48, No. 11, Nov. 2012.

* cited by examiner

DUAL-POLARIZED MAGNETIC ANTENNAS

CROSS REFERENCE TO RELATED APPLICATION

This application claims priority to U.S. Provisional Patent Application No. 61/730,821, entitled "Dual-Polarized Magnetic Antennas" and filed on Nov. 28, 2012, which is incorporated herein by reference.

RELATED ART

In wireless communication systems, communication capacity is generally degraded by fading loss, co-channel interference, and error bursts. In an effort to address some of these problems, diversity techniques have been developed, such as spatial diversity, pattern diversity, and polarization diversity. Such diversity techniques generally use multiple antennas in order to improve the quality and reliability of wireless communication. In this regard, a wireless signal is often reflected along multiple paths before arriving at a receiver resulting in constructive and destructive interference at various points. By using multiple antennas, the receiver has access to multiple observations of the same signal helping to increase the robustness and reliability of the communication.

Polarization diversity uses a pair of antennas with orthogonal polarizations. Such complementary polarizations help to mitigate the effects of polarization mismatches in reflected signals traveling via multiple paths such that fading loss resulting from the mismatches is reduced.

Recently, planar-type dielectric and patch-type dual-polarized antennas have been widely studied to realize miniaturization and low profile, and also to achieve high communication capacity. See, e.g., U.S. Pat. No. 6,549,170; U.S. Pat. No. 6,624,790; C. Y. D. Sim, C. C. Chang, and J. S. Row, "Dual-Feed Dual-Polarized Patch Antenna with Low Cross Polarization and High Isolation," *I.E.E.E. Trans. Antennas Propag.,* 57, pp. 3405-3409, October 2009; D. Y. Lai and F. C. Chen, "A Compact Dual-Band Dual-Polarized Patch Antenna for 1800/5800 MHz Cellular/WLAN System," *Microwave Opt. Technol. Lett.,* 49, No. 2, pp. 345-349, 2007; and S. L. S. Yang, K. M. Luk, H. W. Lai, A A. Kishk, and K. F. Lee, "A Dual-Polarized Antenna with Pattern Diversity," *I.E.E.E. Antennas Propag. Mag.,* 50, No. 6, pp. 71-79, December 2008. In general, a dielectric antenna has narrow bandwidth and poor impedance matching due to a high capacitive component. See, e.g., H. Mosallaei and K. Sarabandi, "Magneto-dielectrics in electromagnetic: Concept and Applications," I.E.E.E. Trans. Antennas Propag., 52, pp. 1558-1567, 2009. The planar dual-polarized antenna is typically designed with a protruded ground or additional parts in order to obtain better isolation and impedance matching. However, this antenna structure and approach lead to large antenna size. In addition, the patch-type dual-antenna has high directivity and gain, but comparatively large antenna volume due to the requirement of using a half-wavelength size patch. Accordingly, patch-type dual-polarized antennas are typically limited to certain applications, such as satellite applications and indoor wireless communication.

Moreover, as mobile devices are becoming smaller, finding suitable antenna structures that provide good communication performance while meeting more stringent size requirements is becoming increasingly problematic.

BRIEF DESCRIPTION OF THE DRAWINGS

The disclosure can be better understood with reference to the following drawings. The elements of the drawings are not necessarily to scale relative to each other, emphasis instead being placed upon clearly illustrating the principles of the disclosure. Furthermore, like reference numerals designate corresponding parts throughout the several views.

FIG. 7 shows antenna return loss ($S_{11}$ and $S_{22}$) versus frequency.

DETAILED DESCRIPTION

The present disclosure generally pertains to dual-polarized magnetic antennas that may be used in various applications and are particularly suited for use in mobile devices, such as cellular telephones and unmanned aerial vehicles (UAVs). In one exemplary embodiment, a dual-polarized antenna has a ferrite substrate that provides for the use of small antenna elements and also provides broad bandwidth and good impedance matching and isolation making the antenna attractive for use in mobile applications. Such antenna also has nearly omnidirectional radiation patterns, orthogonal polarizations, and low cross polarization level. Thus, the antenna overcomes many of the drawbacks of dual-polarized patch antennas, which generally have a relatively large size and high directivity. Further, the radiator type may be selected depending on the desired effective permeability in order to control return loss, isolation, and fractional bandwidth (FBW).

Mobile applications generally require a small size and low profile antenna to allow integration of the communication system into limited space. In addition, high bandwidth and low multipath fading loss are desirable to achieve high data rates and robust communication performance. Owing to possession of both permeability and permittivity, ferrite increases miniaturization factor of $(\mu_r \in_r)^{0.5}$, where $\mu_r$ is relative permeability and $\in_r$ is relative permittivity, and reduces the capacitance of dielectric materials. Antenna polarization diversity uses two orthogonal polarizations to ensure reliable wireless links, thereby increasing communication performance. Accordingly, dual-polarized magnetic antennas provide size reduction, broadening of bandwidth, and improvement of wireless communication quality.

Figure 1:
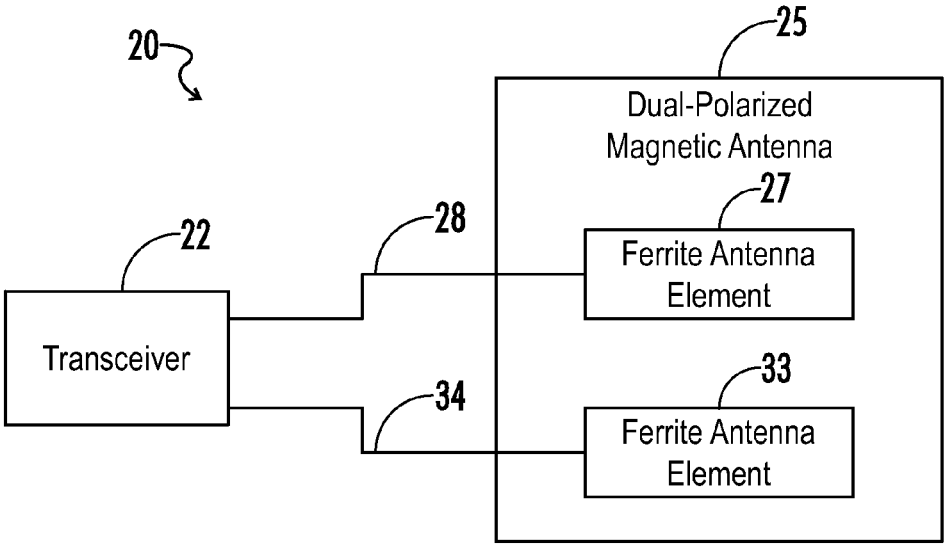
FIG. 1 is a block diagram illustrating an exemplary embodiment of a communication system.

FIG. 1 depicts an exemplary embodiment of a wireless communication system 20 having a transceiver 22 that is coupled to an antenna 25. In particular, the transceiver 22 is coupled to a first ferrite antenna element 27 via a first conductive connection 28 (e.g., a wire or cable), and the transceiver 22 is coupled to a second ferrite antenna element 33 via a second conductive connection 34 (e.g., a wire or cable).

As will be described in more detail hereafter, the ferrite antenna elements 27 and 33 are arranged to have orthogonal polarizations. That is, when the transceiver 22 is transmitting a signal, multiple instances of the same signal are propagated to and, thus, radiate from the antenna elements 27 and 33, respectively. As an example, the same signal may be split within the transceiver 22 such that different portions of the same signal are transmitted to the antenna elements 27 and 33, respectively. Thus, the signal radiating from the antenna element 27 corresponds to (effectively defines the same signal as) the signal simultaneously radiating from the antenna element 33. The configuration of the antenna elements 27 and 33 are controlled so that the polarization of the signal radiating from the antenna element 27 is orthogonal to the polarization of the signal radiating from the antenna element 33.

Figure 2:
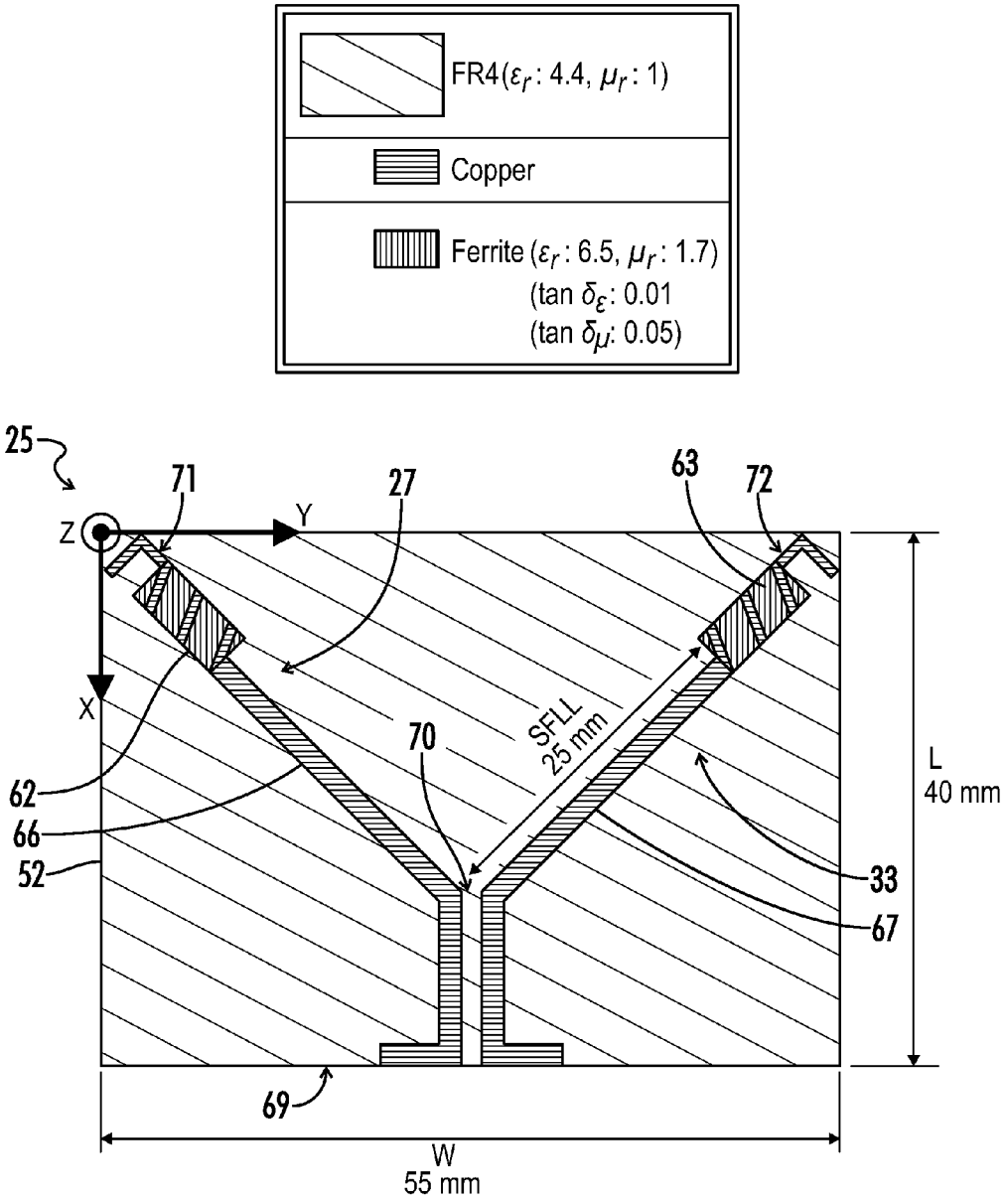
FIG. 2 depicts a top view of an exemplary embodiment of a dual-polarized magnetic antenna, such as is depicted in FIG. 1.
Figure 3:
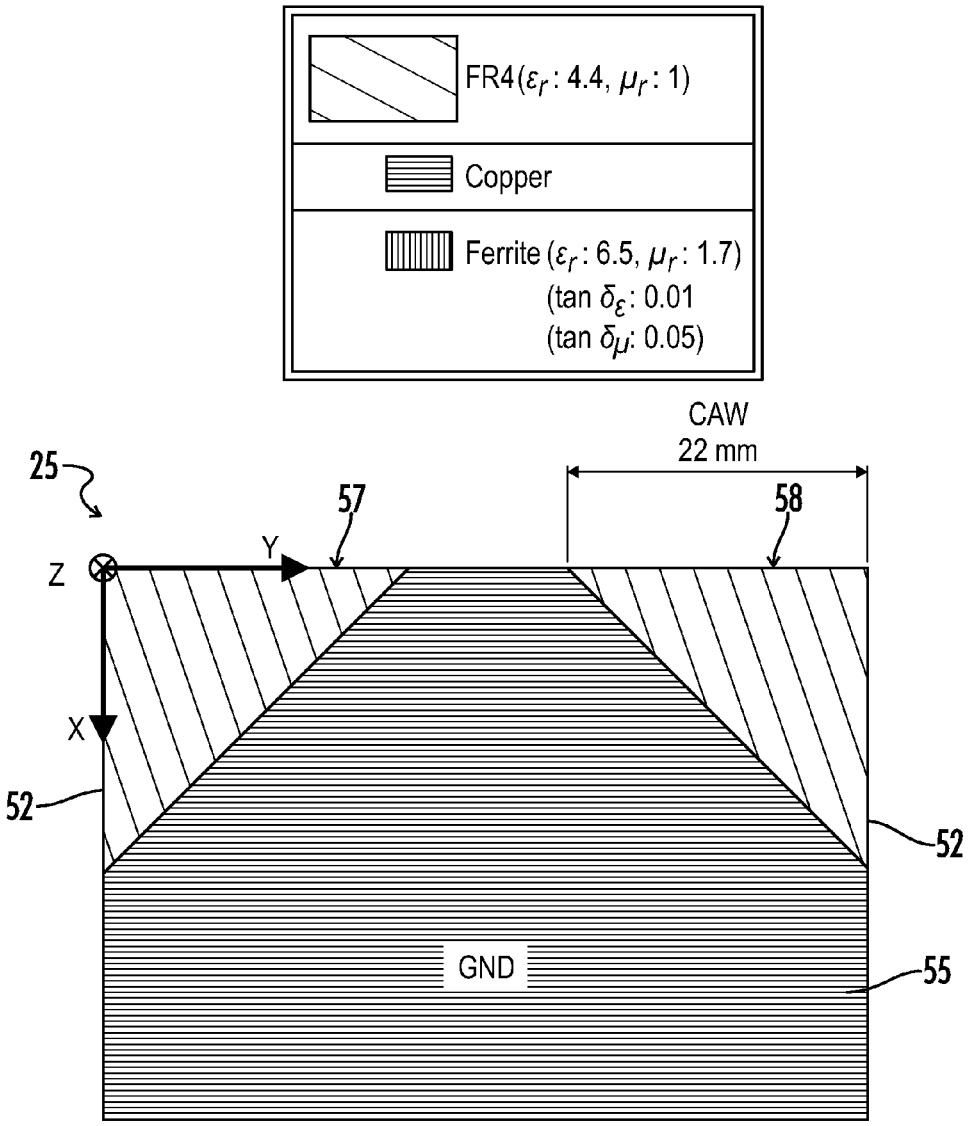
FIG. 3 depicts a bottom view of the antenna depicted in FIG. 2.

FIGS. 2 and 3 depict an exemplary embodiment of an antenna 25 having antenna elements 27 and 33. As shown by FIGS. 2 and 3, the antenna 25 has a base 52 (e.g., a printed circuit board) composed of a dielectric material, such as FR4 epoxy. The base 52 of FIGS. 2 and 3 is rectangular-shaped having a width (W) of about 55 millimeters (mm) in the y-direction and a length (L) of about 40 mm in the x-direction, as shown, but other types of shapes and other dimensions are possible in other embodiments.

As shown by FIG. 3, a ground layer 55 is formed on a bottom surface of the base 52. Such layer 55 is composed of conductive material, such as copper, and forms a ground plane for the antenna 25. This layer 55 is electrically coupled to ground (not specifically shown) of the system 20, referred to as "system ground." The layer 55 covers the bottom surface of the substrate 55 as shown except for corners 57 and 58 on which radiators 62 and 63 are formed on the opposite side of the base 52, as will be described in more detail hereafter. In one exemplary embodiment, a side of each corner 57 and 58 extends about 22 mm in both the x-direction and the y-direction, but other dimensions of uncovered corners 57 and 58 are possible in other embodiments.

Referring to FIG. 2, the antenna element 27 comprises a conductive trace 66 (e.g., copper) that is formed on the base 52 and extends from an edge 69 of the base 52 to the radiator 62. The antenna element 33 similarly comprises a conductive trace 67 (e.g., copper) that is formed on the base 52 and extends from the same edge 69 (relative to the trace 66) of the base 52 to the radiator 63. In one exemplary embodiment, the connections 28 and 34 (FIG. 1) comprise coaxial cables, and SubMiniature version A (SMA) connectors (not shown in FIG. 1) are respectively mounted on or otherwise coupled to each trace 66 and 67 to provide electrical connectivity between the connections 28 and 34 and the traces 66 and 67, respectively.

Further, the radiator 62 is electrically coupled to the trace 66, and the radiator 63 is electrically coupled to the trace 67. In one exemplary embodiment, the width of the trace 66 is about 2 mm for 50 ohm impedance matching. L-shaped conductive traces 71 and 72 are formed on top corners of the base 52 as shown for mechanical stability, impedance matching, and increasing electrical length of the antenna. The traces 71 and 72 are electrically coupled to the radiators 62 and 63, respectively. The width of each radiator 62 or 63 is about 4 mm. Also, the length of each radiator 62 and 63 is about 8 mm, and the height of each radiator 62 and 63 is about 1 mm. However, other dimensions are possible in other embodiments. Note that well-known microfabrication techniques may be used to form the various components of the antenna 25 on the base 52.

As shown by FIG. 2, the traces 66 and 67 are parallel from the edge 69 of the base 52 to about a point 70 where the traces 66 and 67 diverge as they extend further from the edge 69. That is, each trace 66 and 67 forms a bend of about 45 degrees at the point 70 such that the traces 66 and 67 extend away from the point 70 at an angle of about 90 degrees relative to each other. Thus, the radiators 62 and 63, each of which extends in a direction parallel to the trace portion on which it resides, are positioned orthogonally with respect to each other. In this regard, the axis along the elongated length of the radiator 62 is perpendicular to the axis along the elongated length of the radiator 63. This orthogonal orientation of the radiators 62 and 63 results in an orthogonal polarization in the signal radiating from the radiator 62 relative to the signal radiating from the radiator 63.

Figure 4:
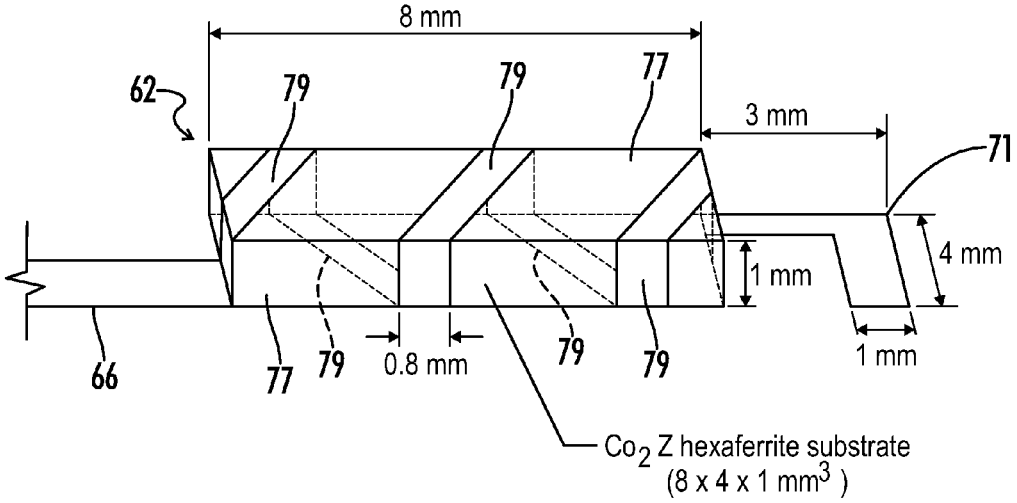
FIG. 4 depicts a perspective view of an exemplary embodiment of a radiator depicted in FIG. 2.

FIG. 4 depicts an exemplary embodiment of the radiator 62. Note that the radiator 63 may be configured the same and have the same dimensions as the radiator 62, and the radiator 63 may be electrically coupled to the trace 67 in the same way that the radiator 62 is electrically coupled to the trace 66, as will be described in more detail below. The exemplary radiator 62 shown by FIG. 4 has a substrate 77 of ferrite material. In one exemplary embodiment, the substrate 77 is a hexagonal ferrite ("hexaferrite"), such as $Ba_3Co_2Fe_{24}O_{41}$, but other types of ferrite materials may be used in other embodiments. Preferably, the substrate 77 has a high anisotropy. In one exemplary embodiment, the substrate 77 has a relative permeability and a relative permittivity both greater than 1.0. With a higher permeability and permittivity, the electrical length of the radiators 62 and 63 (FIG. 2) for the antenna elements 27 and 33 can generally be shorter. A conductive trace 79 (e.g., copper) is formed on the substrate 77 and spirals around the substrate 77. In other embodiments, other configurations, such as bent and meandered designs, and dimensions of the radiator 62 are possible.

During operation, a signal to be transmitted by the antenna 25 is transmitted via both connections 28 and 34 (FIG. 1) from the transceiver 22 to both antenna elements 27 and 33. Referring to FIG. 2, the signal received by the antenna element 27 propagates across the trace 66 and radiates from the radiator 62. Further, the signal received by the antenna element 33 propagates across the trace 67 and radiates from the radiator 63. Note that the antenna elements 27 and 33 also receive wireless signals that are transmitted in parallel to the transceiver 22 via the connections 28 and 34. In one exemplary embodiment, the communication system 20 is implemented within a mobile communication device (not specifically shown), such as a cellular telephone, but other applications of the system 20 are possible in other embodiments.

Figure 5:
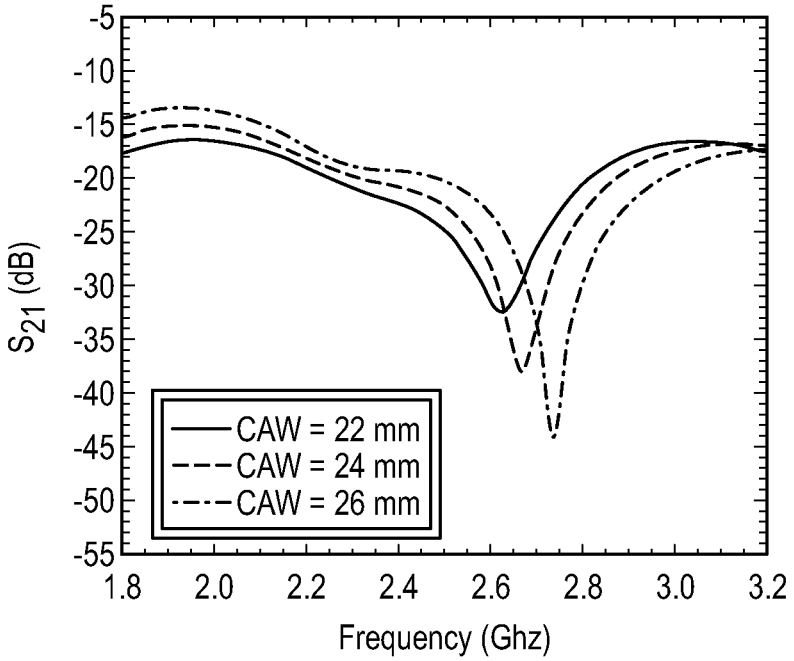
FIG. 5. depicts exemplary simulation results indicating antenna isolation ($S_{21}$) versus frequency for different lengths of a clearance area width (CAW) of the exemplary antenna depicted by FIG. 3.
Figure 6:
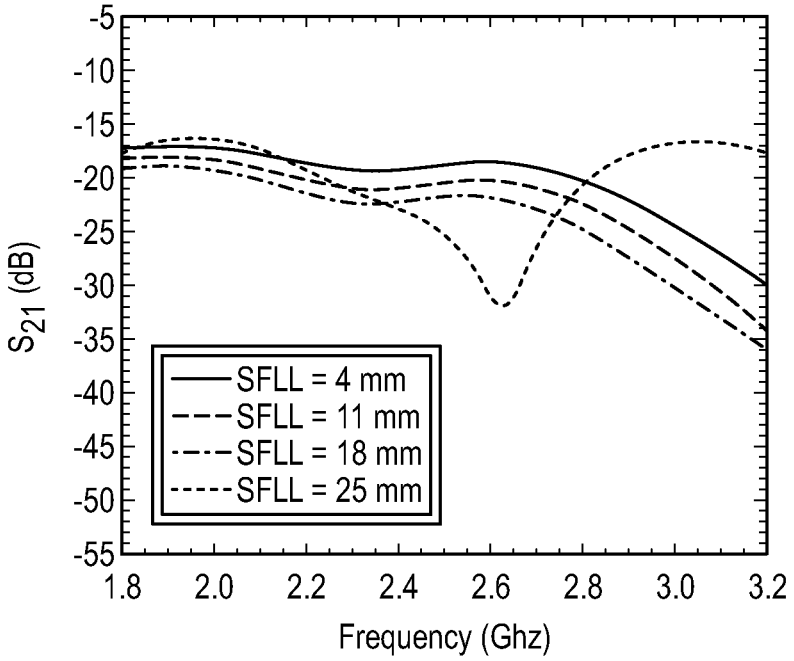
FIG. 6 depicts exemplary antenna isolation simulation results for different lengths of a slanted feed line length (SFLL) of the exemplary antenna depicted by FIG. 2.

In order to increase isolation between the antenna elements 27 and 33, both ground clearance area width (CAW, FIG. 3) and slanted feed line length (SFLL, FIG. 2) were changed. As shown in FIGS. 5 and 6, the isolation at resonant frequency was improved from about 19.4 decibels (dB) to about 23.5 dB as CAW decreased to about 22 mm from about 26 mm, and also an increase in SFLL led to high isolation between two antenna elements 27 and 33. In the experiments, CAW and SFLL were optimized to about 22 mm and 25 mm, respectively.

Figure 7:
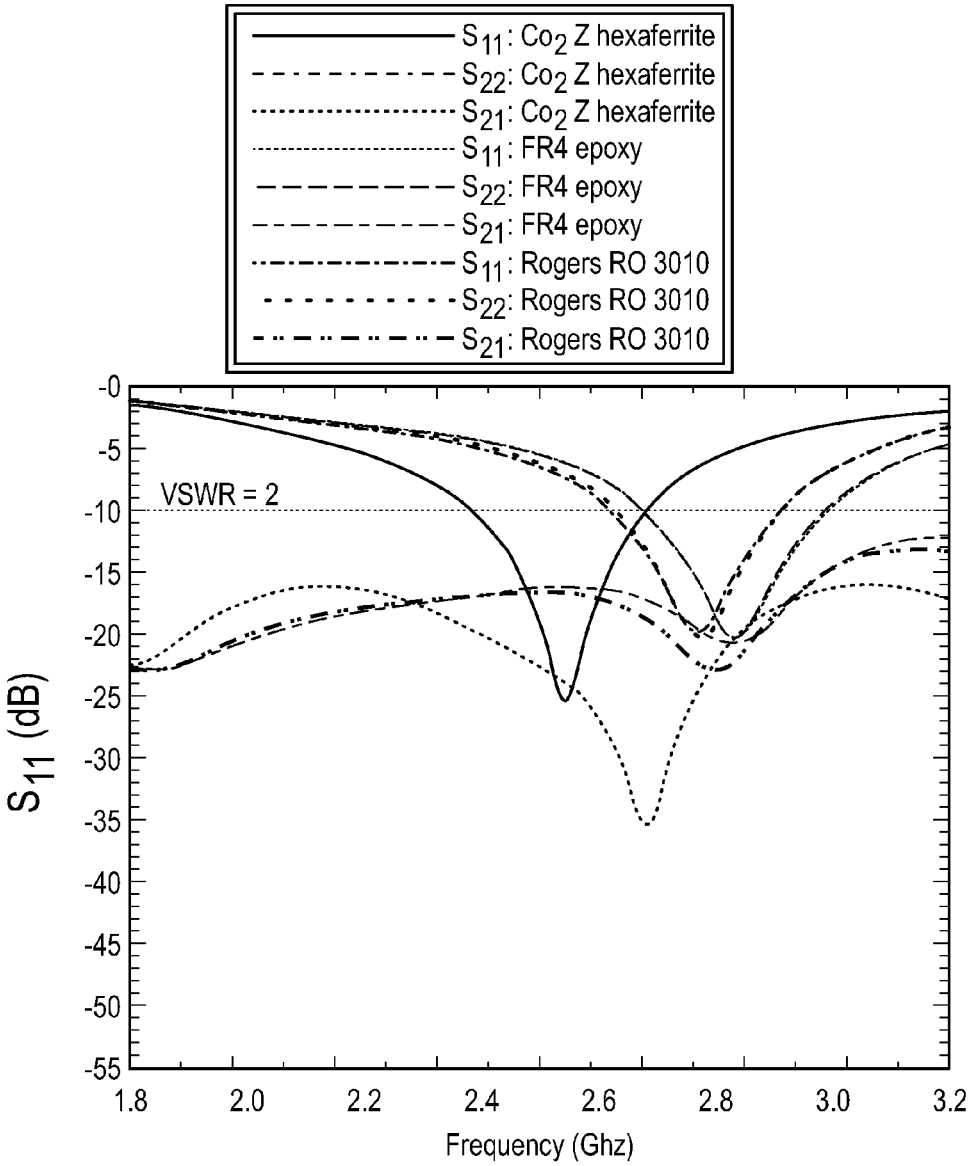
FIG. 7 depicts exemplary antenna performance simulation results for the exemplary antenna depicted by FIG. 2 relative to antenna performance simulation results of a dual-polarized dielectric antenna.

In simulations, a dual-polarized magnetic antenna 25 according to the configuration shown by FIGS. 2 and 3 was tested, and the results were compared to those for a dual-polarized dielectric antenna (not shown). The configuration of such dual-polarized dielectric antenna was similar to that shown by FIGS. 2 and 3 except that the ferrite substrate 77 was replaced by a dielectric substrate of FR4 epoxy. FIG. 7 shows antenna performance simulation results for the experiments, and Table I below shows the measured magnetic and dielectric parameters used for the antenna performance simulation.

TABLE I

Simulated antenna performances for dual-polarized ferrite antenna and dielectric antennas.

| | Materials | | |
|---|---|---|---|
| | Ferrite ($\mu_r$ = 1.7, $\in_r$ = 6.5, tan $\delta_\mu$ = 0.05, tan $\delta_\in$ = 0.01) | FR4 epoxy ($\in_r$ = 4.4, tan $\delta_\in$ = 0.02) | Rogers RO 3010 ($\in_r$ = 10.2, tan $\delta_r$ = 0.003) |
| Resonant Frequency (GHz) | 2.44 | 2.78 | 2.7 |
| Return Loss (dB) | 25 | 21 | 20 |
| Fractional Bandwidth (%) | 13.9 | 12.6 | 11.8 |
| Isolation (dB) at $f_r$ | 22.8 | 20.7 | 21.8 |

The results of the simulation show that resonant frequency and return loss are lower for the magnetic antenna 25 relative to the FR4 and Rogers RO 3010 dielectric antennas, indicating antenna miniaturization and good impedance matching. In addition, the dual-polarized magnetic antenna 25 shows wider fractional bandwidth (FBW) and higher isolation than dual-polarized dielectric antennas. The simulation results in Table I demonstrate that the dual-polarized magnetic antenna 25 outperforms the dual-polarized dielectric antennas.

Figure 8:
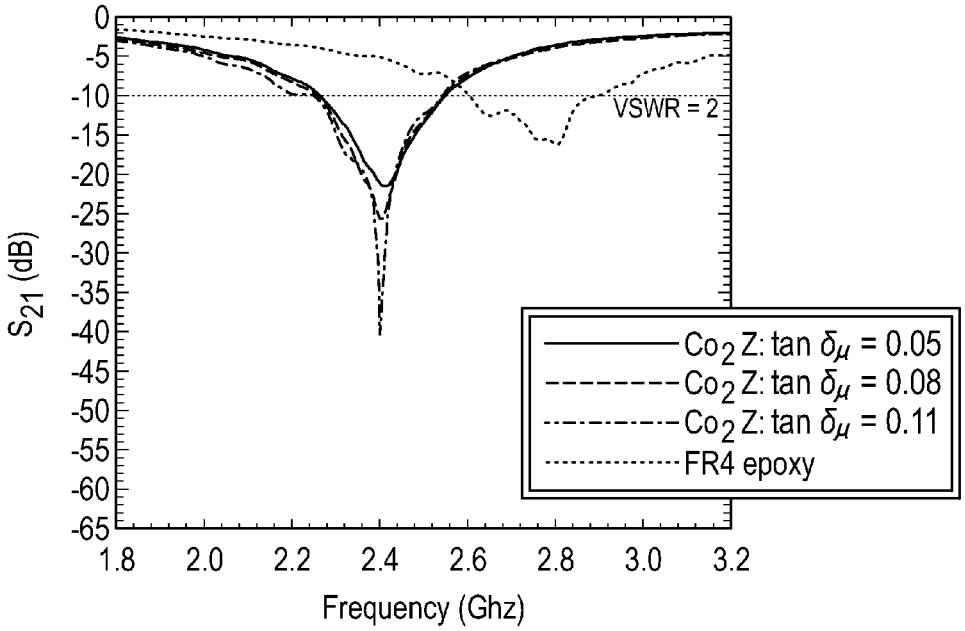
FIG. 8 is a graph of frequency versus return loss measured for exemplary embodiments of a dual-polarized magnetic antenna, such as is depicted by FIG. 2, and a dual-polarized dielectric antenna.
Figure 9:
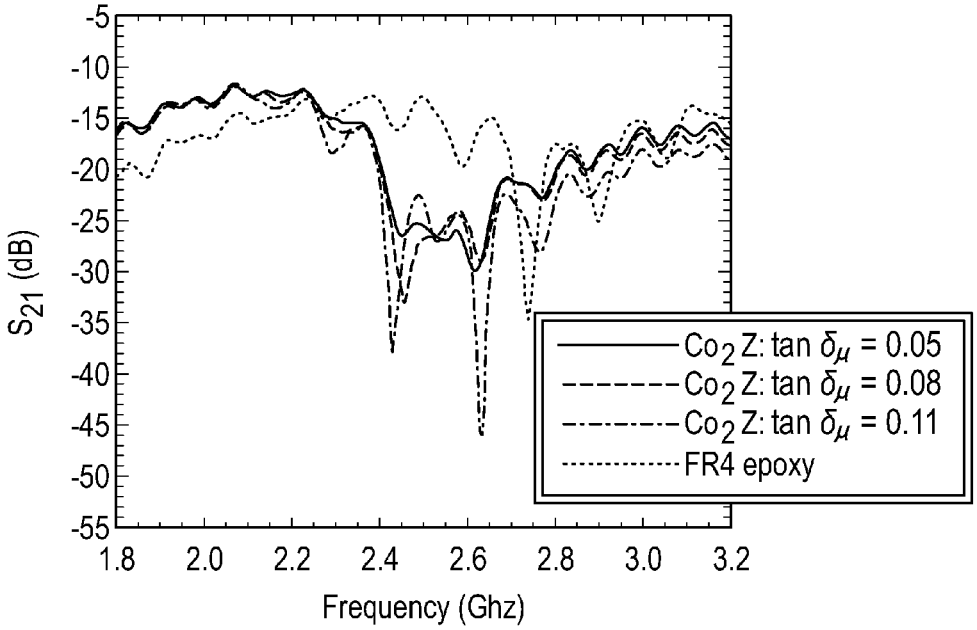
FIG. 9 is a graph of frequency versus isolation measured for exemplary embodiments of a dual-polarized magnetic antenna, such as is depicted by FIG. 2, and a dual-polarized dielectric antenna.
Figure 10:
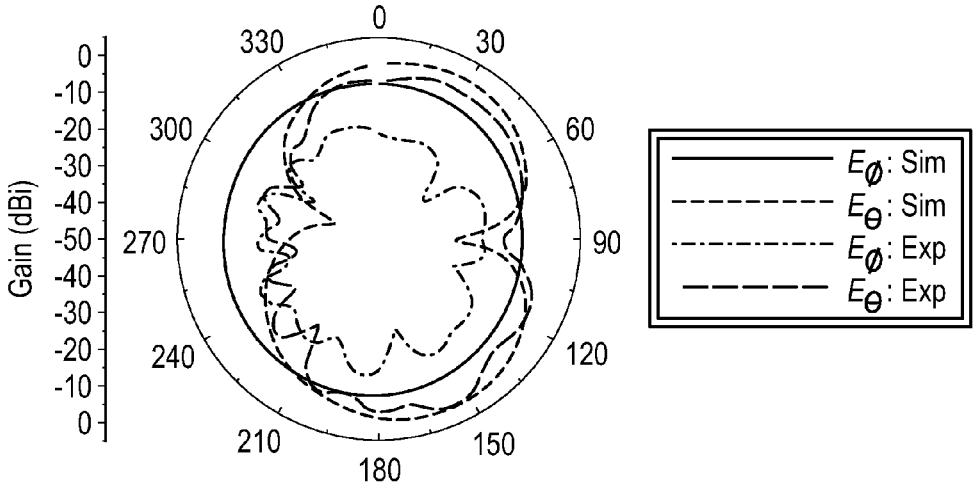
FIG. 10 depicts a normalized radiation pattern measured for the E-plane ($\phi$=45° plane) of one of the ferrite (tan $\delta_\mu$=0.05) antenna elements of a dual-polarized magnetic antenna, such as is depicted by FIG. 2.
Figure 11:
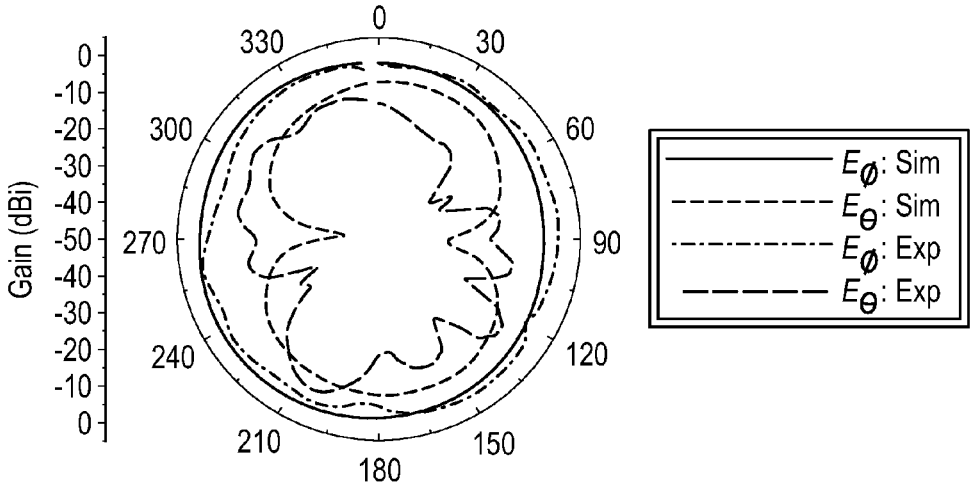
FIG. 11 depicts a normalized radiation pattern measured for the H-plane ($\phi$=315° plane) of the ferrite (tan $\delta_\mu$=0.05) antenna element measured for FIG. 10.
Figure 12:
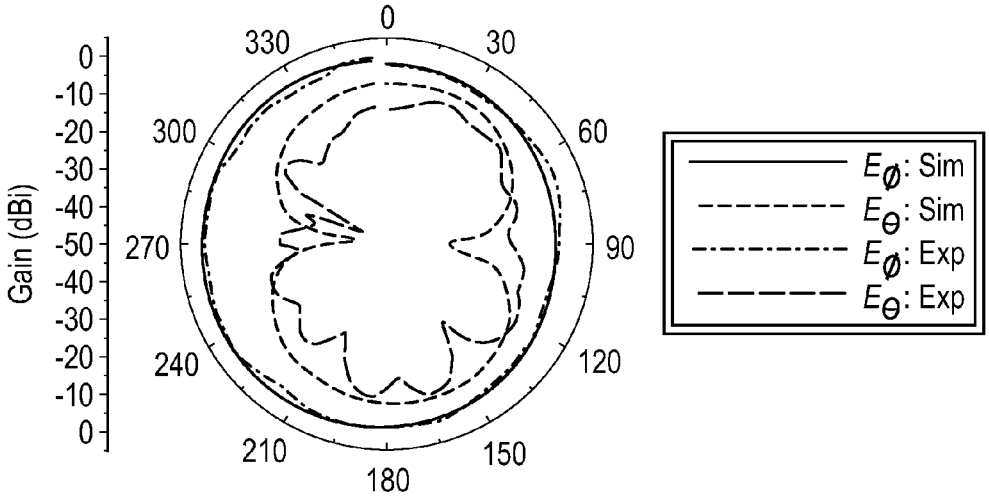
FIG. 12 depicts a normalized radiation pattern measured for the H-plane ($\phi$=45° plane) of another of the ferrite (tan $\delta_\mu$=0.05) antenna elements of the antenna measured for FIG. 10.
Figure 13:
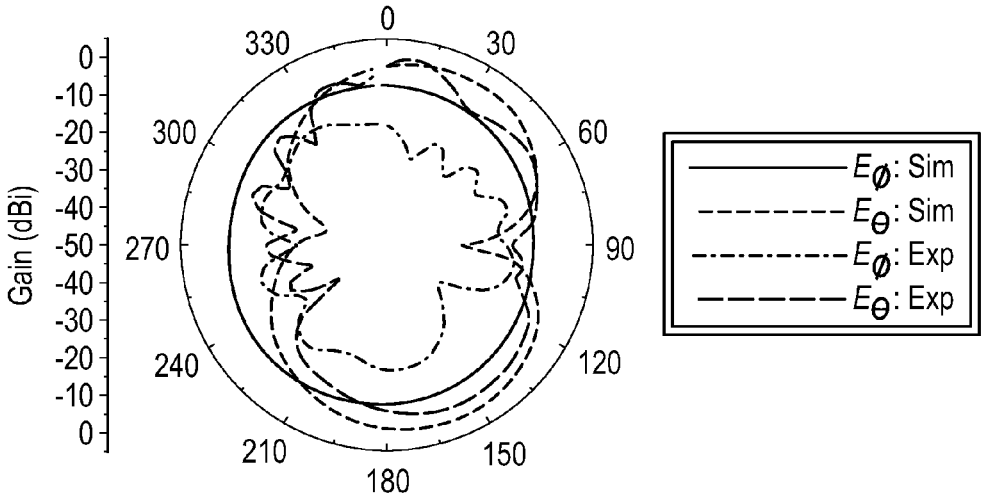
FIG. 13 depicts a normalized radiation pattern measured for the E-plane ($\phi$=315° plane) of the ferrite (tan $\delta_\mu$=0.05) antenna element measured for FIG. 12.

Based on the simulation results, a dual-polarized magnetic antenna element 25 according to the configuration shown by FIGS. 2 and 3 was fabricated. Conventional ceramic process, including shake-milling, drying, and heat treatments were used to prepare $Co_2Z$ ferrite powder. Also, magnetic loss of $Co_2Z$ was controlled by acid washing. Ferrite substrate 77 was fabricated by compacting $Co_2Z$ powder into a rectangular mold and followed by machining of the sintered ferrite body. Then, the conductive material was disposed on the ferrite substrate 77 using copper tape, silver paste, or other conductive materials to form the radiator. The antenna elements 27 and 33 were then mounted on a dielectric base 52, which was milled out with precision milling machine or chemical etching process. Measured scattering parameters of the fabricated antennas 25 are shown in FIGS. 8 and 9. The application of a ferrite substrate 77 decreased resonant frequency compared to the application of a dielectric substrate from about 2.78 Giga-Hertz (GHz) to about 2.41 GHz and increased isolation from about 17.8 dB to about 21.9 dB. In addition, the fabricated dual-polarized magnetic antenna 25 with magnetic tan $\delta_\mu$ of 0.05 showed about 21 dB of return loss and about 11.6% of FBW, while 17 dB and 10.4% for the dielectric antenna. Measured antenna performance is summarized below in Table II.

TABLE II

Measured antenna performance for dual-polarized ferrite antennas and dielectric antenna.

| | Materials | | | |
|---|---|---|---|---|
| | Ferrite (tan $\delta_\mu$ - 0.05) | Ferrite (tan $\delta_\mu$ - 0.08) | Ferrite (tan $\delta_\mu$ - 0.11) | FR4 epoxy |
| Resonant Frequency (GHz) | 2.41 | 2.4 | 2.4 | 2.78 |
| Return Loss (dB) | 21 | 26 | 40 | 17 |
| Fractional Bandwidth (%) | 11.6 | 11.7 | 14.4 | 10.4 |
| Isolation (dB) at $f_r$ | 21.9 | 22.5 | 25.3 | 17.8 |

Normalized radiation patterns of the fabricated dual-polarized antenna 25 with a ferrite substrate having magnetic tan $\delta_\mu$ of 0.05 of FIGS. 2 and 3 were measured in an anechoic chamber with a vector network analyzer (Agilent N5230A) and dual-polarized horn antenna. FIGS. 10-13 show measured normalized radiation patterns of the dual-polarized magnetic antennas 25 in E-plane and the H-plane of each element 27 and 33. The radiation patterns of elements 27 and 33 showed orthogonal polarization ($E_\theta$ and $E_\phi$), which is that E-plane ($\phi$=45° plane) of element 27 is identical to the E-plane ($\phi$=315° plane) of element 33 or vice versa. Accordingly, polarization mismatch and multipath fading loss can be minimized by orthogonal polarization characteristics. A dual-polarized antenna has two orthogonal polarizations, which reduce multipath fading loss, thereby enhancing communication capacity. The fabricated dual-polarized magnetic antennas 25 showed nearly omnidirectional radiation patterns, which are desired for mobile applications. The fabricated dual-polarized magnetic antennas 25 were compared to a fabricated dual-polarized dielectric (e.g., FR4 epoxy) antenna and a commercial omnidirectional dual-polarized antenna for antenna performance analysis. Antenna performance comparisons of the three antennas are indicated below in Table III.

TABLE III

Comparison of measured antenna performance for dual-polarized ferrite and dielectric antenna and commercial antenna.

| | Antenna Tarps | | |
|---|---|---|---|
| | Dual-polarized ferrite (tan $\delta_\mu$ = 0.05) antenna | Dual-polarized ferrite (FR4 epoxy) antenna | Commercial omnidirectional dual-polarized antenna |
| Weight (g) | 10.8 | 10.8 | 350 |
| Resonant Frequency (GHz) | 2.41 | 2.78 | 2.48 |
| Return Loss (dB) | 21 | 26 | 27 |
| Fractional Bandwidth (%) | 11.6 | 10.4 | 13.7 |
| isolation (d13) at $f_r$. | 21 | 17 | 17 |
| Radiation Efficiency (%) | 77.5 (extrapolated RE with magnetic loss of 0.01: 06) | 88.2 | 80.8 |

Figure 14:
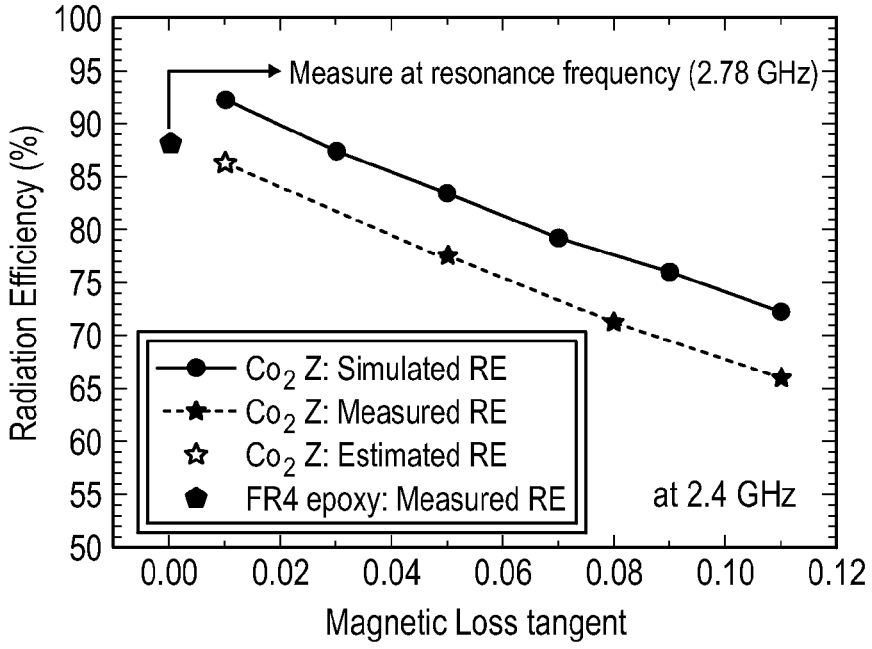
FIG. 14 is a graph of magnetic loss versus radiation efficiency simulated and measured for an exemplary embodiment of a dual-polarized magnetic antenna, such as is depicted by FIG. 2, and a dual-polarized dielectric antenna.

Dual-polarized magnetic antennas 25 showed lighter weight, broader FBW, and better isolation as compared to the commercial antenna. However, the fabricated dual-polarized magnetic antenna 25 has a lower radiation efficiency compared to the fabricated dual-polarized dielectric antenna (not shown) and commercial omnidirectional dual-polarized antenna. This is attributed to high magnetic loss of ferrite antenna substrate 77. Accordingly, the effect of magnetic loss on radiation efficiency was studied. FIG. 14 shows the simulated and measured radiation efficiency of a dual-polarized magnetic antenna 23 and a dual-polarized dielectric antenna at resonant frequency of 2.41 GHz and 2.78 GHz, respectively. The measured radiation efficiency increased to about 77% from about 66% with decreasing magnetic loss from about 0.11 to about 0.05, while the dual-polarized dielectric antenna has about 88.2% of measured radiation efficiency. Based on the radiation efficiency simulation, the radiation efficiency of the dual-polarized magnetic antenna was extrapolated to be about 86% at magnetic tan by $\delta_\mu$ 0.01.

Dual-polarized magnetic antennas 25 show low profile, light weight, orthogonal polarization characteristics, and nearly omnidirectional radiation pattern. Application of a ferrite substrate 77 to the dual-polarized antenna 25 provides improvement of fractional bandwidth, impedance matching, and isolation compared to dual-polarized dielectric antennas. In addition, both permeability and permittivity of the ferrite substrate 77 increase miniaturization factor $(\mu_r \in_r)^{0.5}$. The simulation and experiment results confirm that dual-polarized magnetic antennas can be used to improve communication reliability and increase data rate for mobile applications, such as unmanned vehicles and cellular telephones.

It should be emphasized that the dimensions and shapes of the various embodiments described herein are exemplary. Various other sizes and shapes of the components described herein are possible.

The invention claimed is:

1. A dual-polarized magnetic antenna, comprising:

a base having a first surface;

a first ferrite antenna element positioned on the first surface of the base and having a first conductive trace coupled to a first radiator, the first radiator having a first elongated substrate comprising ferrite and the first conductive trace coupled to a first conductive connection; and a second ferrite antenna element positioned on the first surface of the base and having a second conductive trace coupled to a second radiator, the second radiator having a second elongated substrate comprising ferrite and the second conductive trace coupled to a second conductive connection, wherein the second ferrite antenna element is electrically isolated from the first ferrite antenna element.

2. The antenna of claim 1, wherein the first elongated substrate comprises hexagonal ferrite.

3. The antenna of claim 1, wherein the first elongated substrate comprises $Ba_3Co_2Fe_{24}O_{41}$.

4. The antenna of claim 1, wherein the first radiator has a third conductive trace spiraling around the first elongated substrate.

5. The antenna of claim 4, wherein the third conductive trace is electrically coupled to an L-shaped conductive trace extending from the first radiator towards an edge of the base.

6. The antenna of claim 1, wherein the first radiator is electrically coupled to a transceiver, and wherein the second radiator is electrically coupled to the transceiver.

7. The antenna of claim 1, wherein the first elongated substrate is positioned orthogonally relative to the second elongated substrate.

8. The antenna of claim 1, wherein the ferrite of the first elongated substrate has a relative permeability greater than 1.0.

9. The antenna of claim 8, wherein the ferrite of the first elongated substrate has a relative permittivity greater than 1.0.

10. The antenna of claim 1, wherein the first radiator has a first end and a second end opposite the first end, the first end electrically coupled to an L-shaped conductive trace and the second end electrically coupled to the first conductive trace.

11. The antenna of claim 1, wherein the first conductive trace has a first portion and a second portion coupled to the first portion and the second conductive trace has a third portion and a fourth portion coupled to the third portion, wherein the first portion is parallel to the third portion and the second portion is orthogonal to the fourth portion.

12. The antenna of claim 11, wherein the second portion is positioned at about a 45 degree angle with respect to the first portion and the fourth portion is positioned at about a 45 degree angle with respect to the third portion.

13. The antenna of claim 1, wherein the ferrite of the first elongated substrate has a magnetic loss tangent of less than or 0.05.

14. A dual-polarized magnetic antenna, comprising:

a base having a first surface;

a first ferrite antenna element positioned on the first surface of the base and having a first trace coupled to a first radiating means for radiating a first signal received from a transceiver, the first radiating means comprising ferrite and the first trace coupled to a first conductive connection at an edge of the base; and a second ferrite antenna element positioned on the first surface of the base and having a second trace coupled to a second radiating means for radiating a second signal received from the transceiver, the second radiating means comprising ferrite and the second trace coupled to a second conductive connection at the edge of the base, wherein the second ferrite antenna element is electrically isolated from the first ferrite antenna element.

15. A method, comprising the steps of:

transmitting a first signal and a second signal to a dual-polarized magnetic antenna, the dual-polarized magnetic antenna comprising a first antenna element positioned on a first surface of a base to receive the first signal and a second antenna element positioned on the first surface of the base to receive the second signal, wherein the second antenna element is electrically isolated from the first antenna element, the first antenna element having a first radiator and the second antenna element having a second radiator, the first radiator having a first elongated substrate comprising ferrite and the second radiator having a second elongated substrate comprising ferrite;

radiating the first signal from the first radiator; and radiating the second signal from the second radiator, wherein the radiating steps are performed simultaneously, and wherein the first signal corresponds to the second signal.

16. The method of claim 15, wherein the first elongated substrate comprises hexagonal ferrite.

17. The method of claim 15, wherein the first elongated substrate comprises $Ba_3Co_2Fe_{24}O_{41}$.

18. The method of claim 15, wherein the first radiator has a conductive trace spiraling around the first elongated substrate.

19. The method of claim 15, wherein the first elongated substrate is positioned orthogonally relative to the second elongated substrate.

20. The method of claim 15, wherein the ferrite of the first elongated substrate has a relative permeability greater than 1.0.

21. The method of claim 20, wherein the ferrite of the first elongated substrate has a relative permittivity greater than 1.0.

22. The antenna of claim 1, wherein the base has a second surface opposite the first surface and the antenna further comprises a ground plane positioned on the second surface of the base to isolate the first ferrite antenna element and the second ferrite antenna element.

23. The antenna of claim 22, wherein the second surface has a first area corresponding to a location of the first radiator on the first surface and a second area corresponding to a location of the second radiator on the first surface, the ground plane extending between the first area and the second area.

* * * * *